United States Patent [19]

Phelps

[11] Patent Number: 5,018,656

[45] Date of Patent: May 28, 1991

[54] STAPLING APPARATUS

[75] Inventor: Russell L. Phelps, Rochester, N.Y.

[73] Assignee: Xerox Corporation, Stamford, Conn.

[21] Appl. No.: 75,706

[22] Filed: Jul. 20, 1987

[51] Int. Cl.[5] ..... B27F 7/21

[52] U.S. Cl. ..... 227/84; 227/156

[58] Field of Search ..... 227/84, 156

[56] References Cited

U.S. PATENT DOCUMENTS 4,318,555 3/1982 Adamski et al. ..... 283/7

4,356,947 11/1982 Marshall et al. ..... 227/5

4,389,011 6/1983 Lovibond ..... 227/5

*Primary Examiner*—Paul A. Bell

*Attorney, Agent, or Firm*—H. Fleischer; J. E. Beck; R. Zibelli

[57] ABSTRACT

An apparatus in which a set of sheets is stapled together. A predetermined length of wire is fed to the stapler. A wire cutter is positioned along the wire as a function of the movement of the clamper clamping the sheets of the set. The wire cutter cuts the wire at the cutting position and a forming bar forms the cut wire into a staple. A driving bar then drives the staple through the set of sheets to staple the sheets together.

32 Claims, 9 Drawing Sheets

STAPLING APPARATUS

This invention relates generally to an electrophotographic printing machine, and more particularly concerns an apparatus for stapling sets of finished copy sheets.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. The copy sheets are then collected and stapled together into sets of copy sheets. The stapled sets of copy sheets are then stacked for presentation to the machine operator.

In a high speed commercial printing machine of the foregoing type, staplers are frequently employed to attach the sheets of the set of copy sheets together. Various types of staplers may be used. For example, the stapler may use preformed staples which are pre-cut to fixed lengths, or those in which the staples are cut from a continuous wire. In either case, the staple legs are driven through the set of sheets until the crown of the staple lies against one surface of the set of sheets. The staple legs are then clinched, i.e. bent over against the opposite surface of the set of sheets. The printing machine produces sets of sheet having differing thicknesses, i.e. having different numbers of sheets therein and/or different weight copy paper. Thus, it is desirable to vary the length of the legs of the staples as a function of the thickness of the set of copy sheets. One way of achieving this, when preformed staples are used, is by having the operator change the staples when the thickness of the set varies significantly. This is time consuming and reduces the output capacity of the printing machine. Alternatively, when the staples are cut from continuous wire, the length of the staple legs may be varied. Preferably, the length of the staple being cut is automatically adjusted as a function of the thickness of the set of sheets being stapled.

Various approaches have been devised for varying the length of the legs of staples being used to attach the sheets of the set of sheets together. The following disclosures appear to be relevant:

U.S. Pat. No. 4,318,555; Patentee: Adamski et al.; Issued: Mar. 9, 1982

U.S. Pat. No. 4,356,947; Patentee: Marshall et al.; Issued Nov. 2, 1982.

U.S. Pat. No. 4,4389,011; Patentee: Lovibond; Issued: Jun. 21, 1983.

The relevant portions of the foregoing patents may be summarized as follows:

Adamski et al. discloses a stapler capable of driving staples of at least two different lengths. The selection of the staple lengths may be preprogrammed into the logic and control system or selected by a switch.

Marshall et al. and Lovibond describe stitchers in which the length of wire is determined by the thickness of the copy set. The length of wire presented to the stitcher head is determined by an inhibitor member positioned by the clincher in dependence on the thickness of the set of sheets. The inhibitor member limits the movement of the cutter blocks according to the thickness of the copy set. A driver clamps the wire into position on an anvil. As the former moves downward, an actuator operates a cutter to sever the wire as it is formed into a U shape. The driver then drives the staple into the copy sheet set.

In accordance with one aspect of the present invention, there is provided an apparatus for stapling sheets. The apparatus includes means for holding a predetermined length of wire and a wire cutter. Means are provided for clamping the set of sheets. Means move the clamping means into engagement with the set of sheets. Means, responsive to the movement of the clamping means, move the wire cutter along the predetermined length of wire in the holding means to a cutting position. The moving means applies a force on the wire cutter causing the wire cutter to shear the wire at the cutting position. Means are provided for forming the cut piece of wire into a staple. Means drive the staple through the set of sheets to staple the sheets together.

Pursuant to another aspect of the features of the present invention, there is provided an electrophotographic printing machine of the type in which successive copy sheets having indicia recorded thereon are compiled into sets and the sheets of each set are stapled together. The improved stapling apparatus includes means for holding a predetermined length of wire and a wire cutter. Means are provided for clamping the set of sheets. Means move the clamping means into engagement with the set of sheets. Means, responsive to the movement of the clamping means, move the wire cutter along the predetermined length of wire in the holding means to a cutting position. The moving means applies a force on the wire cutter causing the wire cutter to shear the wire at the cutting position. Means are provided for forming the cut piece of wire into a staple. Means drive the staple through the set of sheets to staple the sheets together.

Still another feature of the present invention is a method of stapling a set of sheets. A predetermined length of wire is held and a sheet clamper moved into engagement with the set of sheets. As the sheet clamper moves into engagement with the set of sheets, a wire cutter is positioned along the predetermined length of wire to a cutting position in response to movement of the sheet clamper. The wire is cut at the cutting position and formed into a staple. The staple is then driven through the set of sheets to staple the sheets together.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
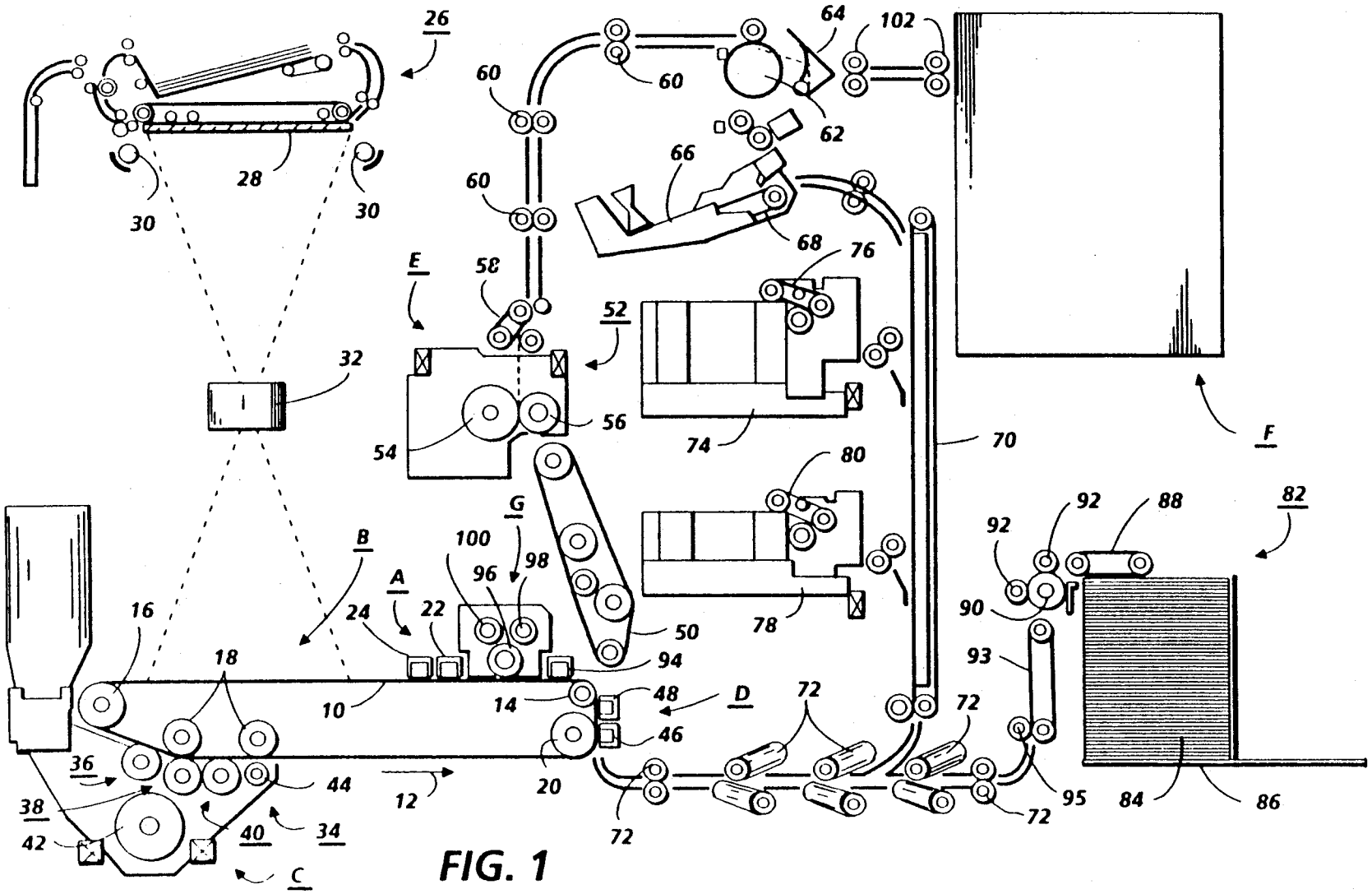
FIG. 1 is a schematic elevational view depicting an illustrative electrophotographic printing machine incorporating the sheet stapling apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the sheet stapling apparatus of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24 charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of photoconductive belt 10 is advanced through imaging station B. At imaging station B, a document handling unit, indicated generally by the reference numeral 26, is positioned over platen 28 of the printing machine. Document handling unit 26 sequentially feeds documents from a stack of documents placed by the operator in the document stacking and holding tray. The original documents to be copied are loaded face up into the document tray on top of the document handling unit. A document feeder located below the tray forwards the bottom document in the stack to rollers. The rollers advance the document onto platen 28. When the original document is properly positioned on platen 28, a belt transport is lowered onto the platen with the original document being interposed between the platen and the belt transport. After imaging, the original document is returned to the document tray from platen 28 by either of two paths. If a simplex copy is being made or if this is the first pass of a duplex copy, the original document is returned to the document tray via the simplex path. If this is the inversion pass of a duplex copy, then the original document is returned to the document tray through the duplex path. Imaging of a document is achieved by two Xenon flash lamps 30 mounted in the optics cavity which illuminate the document on platen 28. Light rays reflected from the document are transmitted through lens 32. Lens 32 focuses light images of the original document onto the charged portion of the photoconductive surface of belt 10 to selectively dissipate the charge thereon. This records an electrostatic latent image on photoconductive belt 10 which corresponds to the informational areas contained within the original document. Thereafter, photoconductive belt 10 advances the electrostatic latent image recorded thereon to development station C.

At development station C, a magnetic brush developer unit, indicated generally by the reference numeral 34, has three developer rolls, indicated generally by the reference numerals 36, 38 and 40. A paddle wheel 42 picks up developer material and delivers it to the developer rolls. When developer material reaches rolls 36 and 38, it is magnetically split between the rolls with half the developer material being delivered to each roll. Photoconductive belt 10 is partially wrapped about rolls 36 and 38 to form extended development zones. Developer roll 40 is a cleanup roll. Magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detack the copy sheet from belt 10. Conveyor 50 advances the copy sheet to fusing station E.

Fusing station E includes a fuser assembly, indicated generally by the reference numeral 52 which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 58. Decurler 58 bends the copy sheet in one direction to put a known curl in the copy sheet and then bends it in the opposite direction to remove that curl.

Forwarding rollers 60 then advance the sheet to duplex turn roll 62. Duplex solenoid gate 64 guides the sheet to the finishing station F or to duplex tray 66. The details of finishing station F will be described hereinafter with reference to FIG. 2. Duplex solenoid gate 64 diverts the sheet into duplex tray 66. The duplex tray 66 provides an intermediate or buffer storage for those sheets that have been printed on one side and on which an image will be subsequently printed on the second, opposed side thereof, i.e. the sheets being duplexed. The sheets are stacked in duplex tray 66 face down on top of one another in the order in which they are copied.

In order to complete duplex copying, the simplex sheets in tray 66 are fed, in seriatim, by bottom feeder 68 from tray 66 back to transfer station D via conveyor 70 and rollers 72 for transfer of the toner powder image to the opposed sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 74. The secondary tray 74 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 76. Sheet feeder 70 is a friction retard feeder utilizing a feed belt and take-away rolls to advance successive copy sheets to transport 70 which advances the sheets to rolls 72 and then to transfer station D.

Copy sheets may also be fed to transfer station D from the auxiliary tray 78. The auxiliary tray 78 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to transport 70 which advances the sheets to rolls 72 and then to transfer station D.

Secondary tray 74 and auxiliary tray 78 are secondary sources of copy sheets. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away drive roll 90 and idler rolls 92. The drive roll and idler rolls guide the sheet onto transport 93. Transport 93 and idler roll 95 advance the sheet to rolls 72 which, in turn, move the sheet to transfer station station D.

Invariably, after the copy sheet is separated from the photoconductive surface of belt 10, some residual particles remain adhering thereto. After transfer, photoconductive belt 10 passes beneath corona generating device 94 which charges the residual toner particles to the proper polarity. Thereafter, the precharge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 96 and two de-toning rolls 98 and 100, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
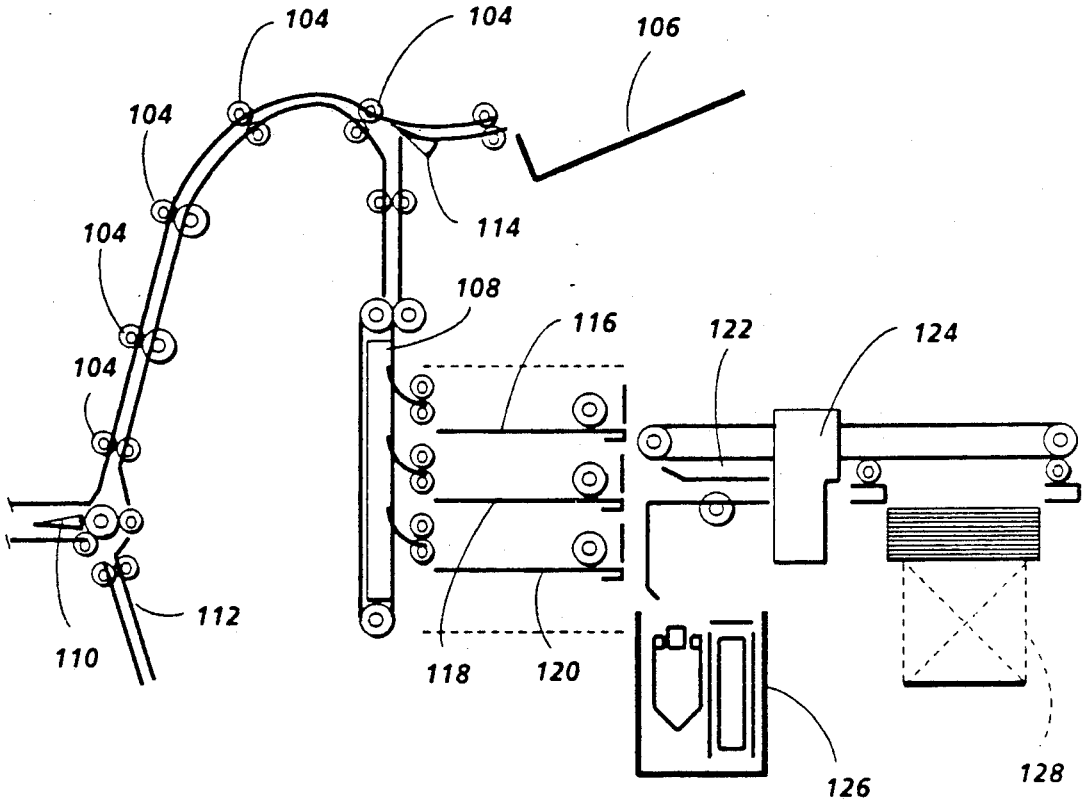
FIG. 2 is a schematic elevational view showing the finishing station of the FIG. 1 printing machine with the sheet stapling apparatus.

Referring now to FIG. 2, the general operation of finishing station F will now be described. Finishing station F receives fused copies from rolls 102 (FIG. 1) and delivers them to solenoid actuated gate 110. Gate 110 diverts the copy sheet to either registration rolls 104 or inverter 112. A tri-roll nip is used to drive sheets into and out of the inverter. Inverter 112 has a compression spring which assists in reversing the direction of the sheets and assists in driving them out of the inverter. Inverter 112 is driven by a reversible AC motor. Two cross roll registration nips are used to register the sheets. The cross roll registration nips are driven by the sheet path drive motor. Rolls 104 advance the copy sheets to gate 114. Gate 114 diverts the sheets to either the top tray 106 or to vertical transport 108. Vertical transport 108 is a vacuum transport which transports sheets to any one of three bins 116, 118 or 120. Bins 116, 118, and 120 are used to compile and register sheets into sets. The bins are driven up or down by a bidirectional AC bin drive motor adapted to position the proper bin at the unloading position. A set transport 122 has a pair of set clamps mounted on two air cylinders and driven by four air valve solenoids. Two of the air valves are used for positioning the set transport and two are used for the retract function. The set transport is used to transport sets from the bins to sheet stapling apparatus 124, binder 126 and sheet stacker 128. The stapled, bound, or unfinished sets are delivered to stacker 128 where they are stacked for delivery to the operator.

Figure 3:
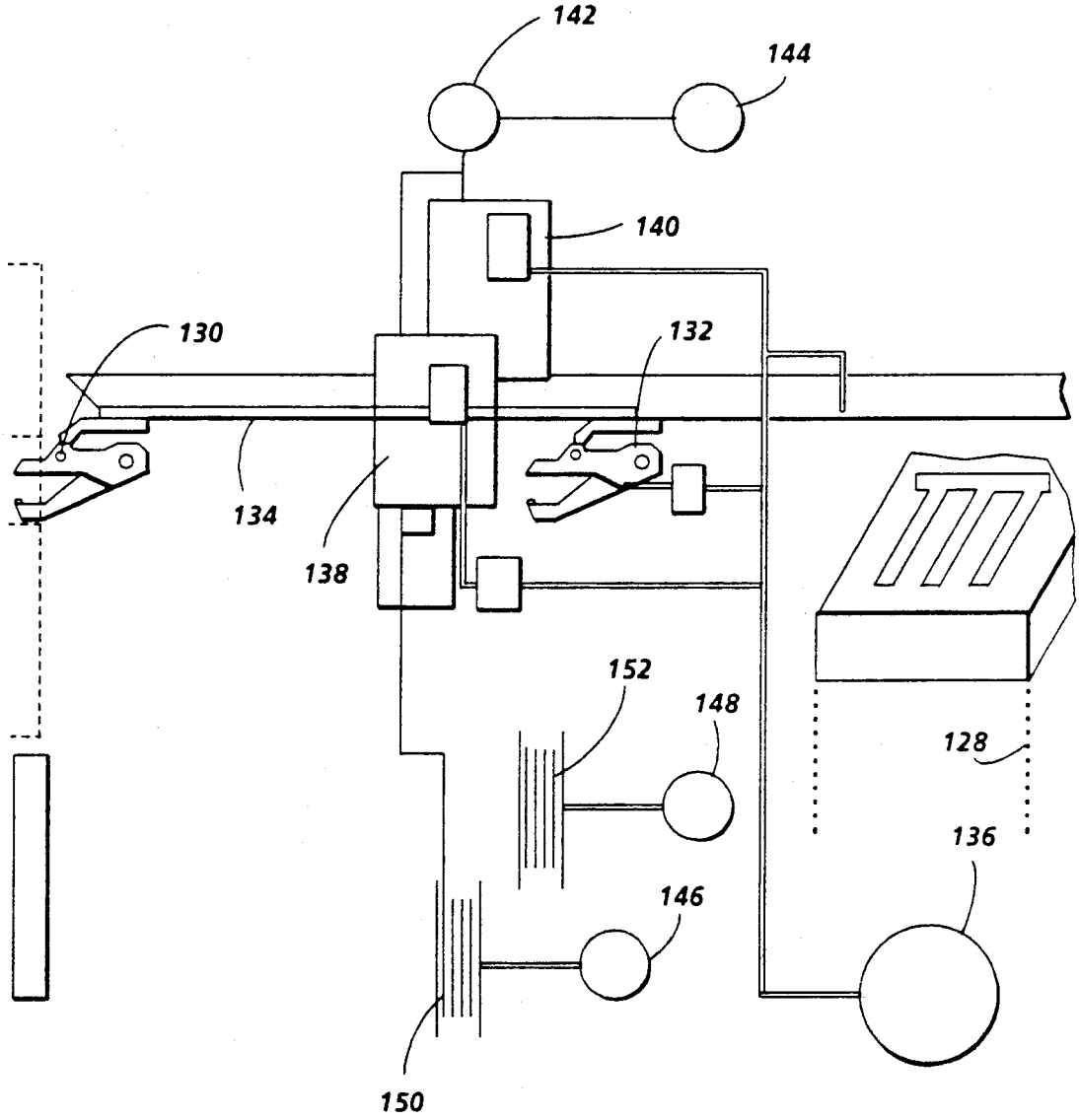
FIG. 3 is a schematic elevational view further illustrating the FIG. 2 finishing station with the stapling apparatus.

Turning now to FIG. 3, there is shown the general operation of the sheet stapling apparatus in the finishing station station. As shown, set clamps 130 and 132 are mounted on a set transport carriage 134 and pneumatically driven by compressor 136. Set clamp 130 removes sets from bins 116, 118 and 120. These sets are delivered to stapling apparatus 124, which includes staplers 138 and 140, where they can be single or dual stapled. Set clamp 132 removes the sets from stapling apparatus 124 and delivers them to stacker 128, where they are stacked for delivery to the operator. Set clamps 130 and 132 are mounted fixedly on carriage 134 and move in unison therewith. In operation, the clamps pick up their sets, as required, and move them to their release positions. They release their sets and begin to move to the home position. As the clamps move from the release position to the home position, a cam follower mechanism raises both clamps to insure that they can clear the stacks just delivered, on their return to their pick up position. Staplers 138 and 140 are pneumatically driven. The staplers are automatically moved to the preselected staple positions by a bi-directional AC motor 142 and accurately positioned via an encoder 144. Motor 142 is located at the rear of the staple positioning assembly. The motor drives a belt and pulley assembly to move the staplers to the correct position. Encoder 144 is mounted above the pulley and the resulting pulses generated thereby are used by the control system to determine the amount of movement of the staplers in order to position the staplers at the selected positions. The staplers staple in either of three modes; portrait, landscape, or dual staple. Stapler 138 is used to place a staple in the upper left hand corner of a set of copy sheets having printed text parallel to the short edge. In the landscape mode, stapler 140 is used to place a staple in the upper left hand corner of a set of copy sheets with text printed parallel to the long edge. In the dual stapling mode, the staplers are placed in positions dependent upon the size of the copy sheet being run. Each stapler clamps the set of copy sheets in the stapler head, cuts and forms the wire, and drives the staple through the set of copy sheets. A clincher bends the legs of the driven staple over against the set of copy sheet to complete the staple cycle.

Wire feed motors 146 and 148 rotate spools 150 and 152 to advance wire to staplers 138 and 140, respectively. The wire feed motors are located beneath each stapler head assembly. Stapler 138 and stapler 140 are substantially identical to one another, the only difference being that they are opposite hand assemblies. Each motor drives a pair of meshed gears. The gears have a groove around the outside circumference and the channel or hole formed by the grooves of the meshed gears drives the wire to the stapler head. Motors 146 and 148 are AC motors. Compressor 136 is driven by an AC motor and provides air pressure for the pneumatically controlled set clamps, set transport carriage and staplers. Air valves and solenoids are located adjacent the stapler head air cylinder. The solenoid energizes to open the valve and direct compressed air to the stapler head assembly 154 (FIG. 4) air cylinder. Similarly, solenoids associated with clincher 156 (FIG. 4) energize to open the valves and direct compressed air to the clincher air cylinder.

Figure 4:
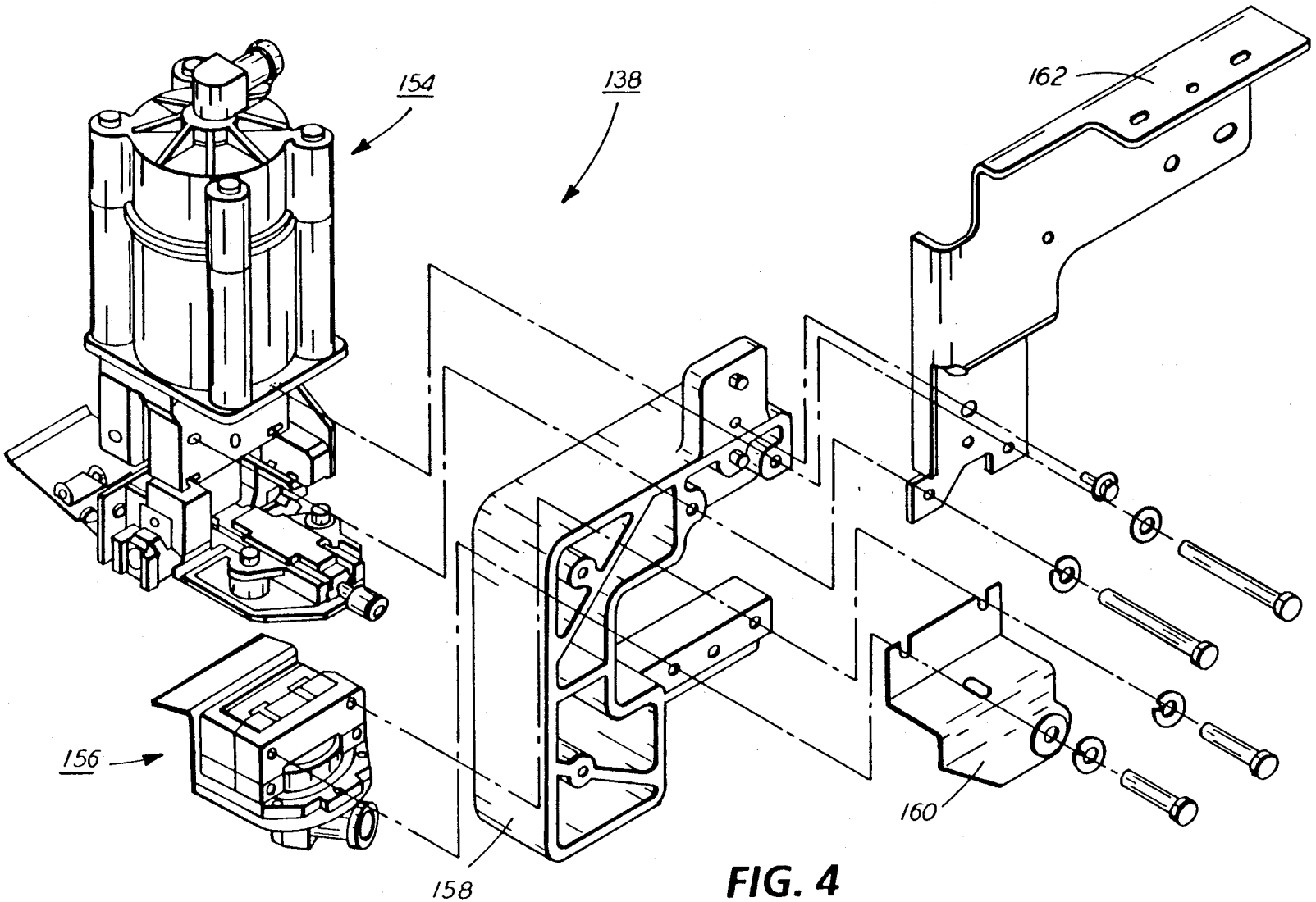
FIG. 4 is an exploded, perspective view of the FIG. 3 sheet stapling apparatus.
Figure 5:
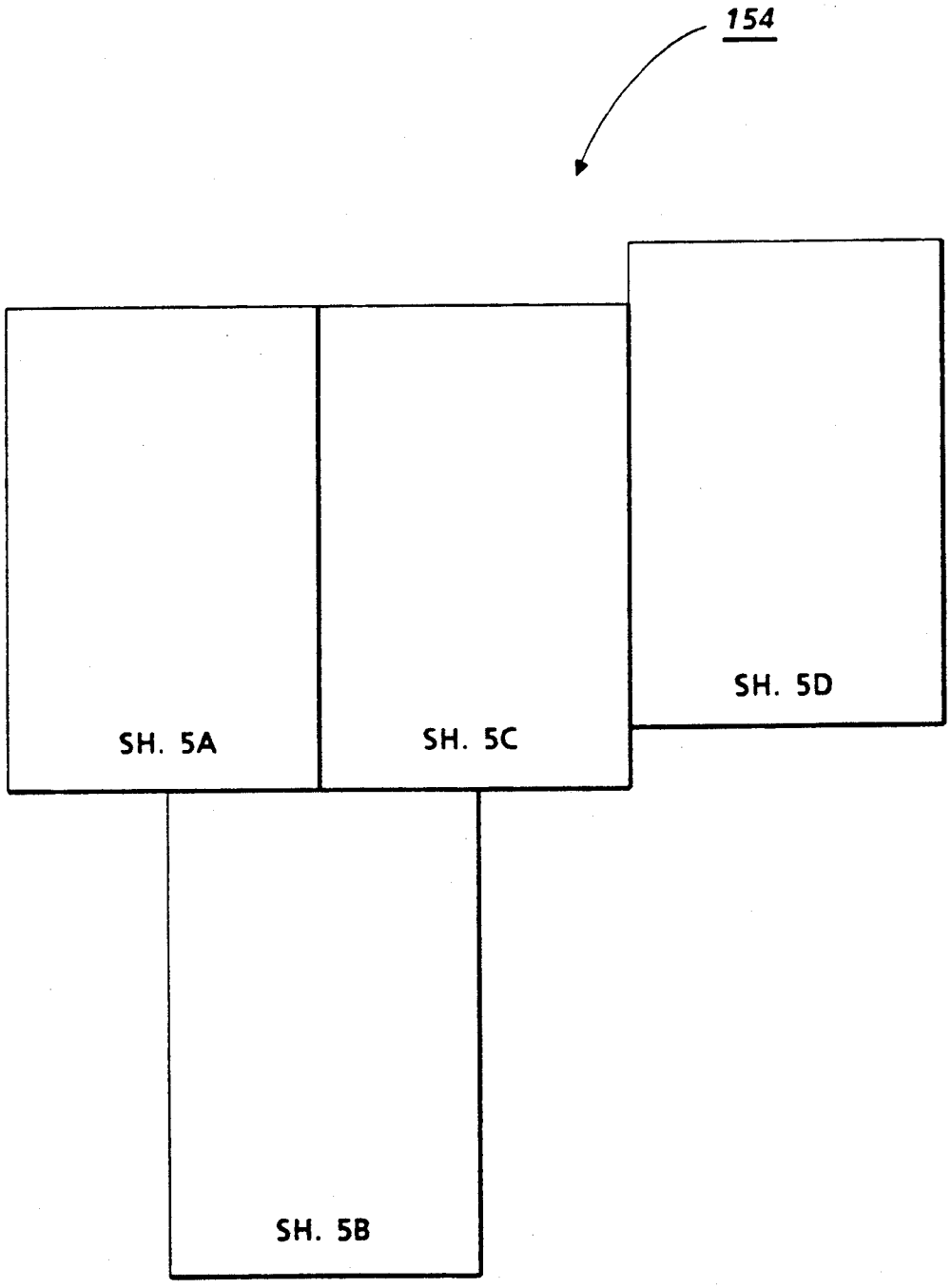
FIG. 5 is a layout showing the relationship of the drawings detailing an exploded, perspective view of the stapler head of the FIG. 4 sheet stapling apparatus.
Figure 5A:
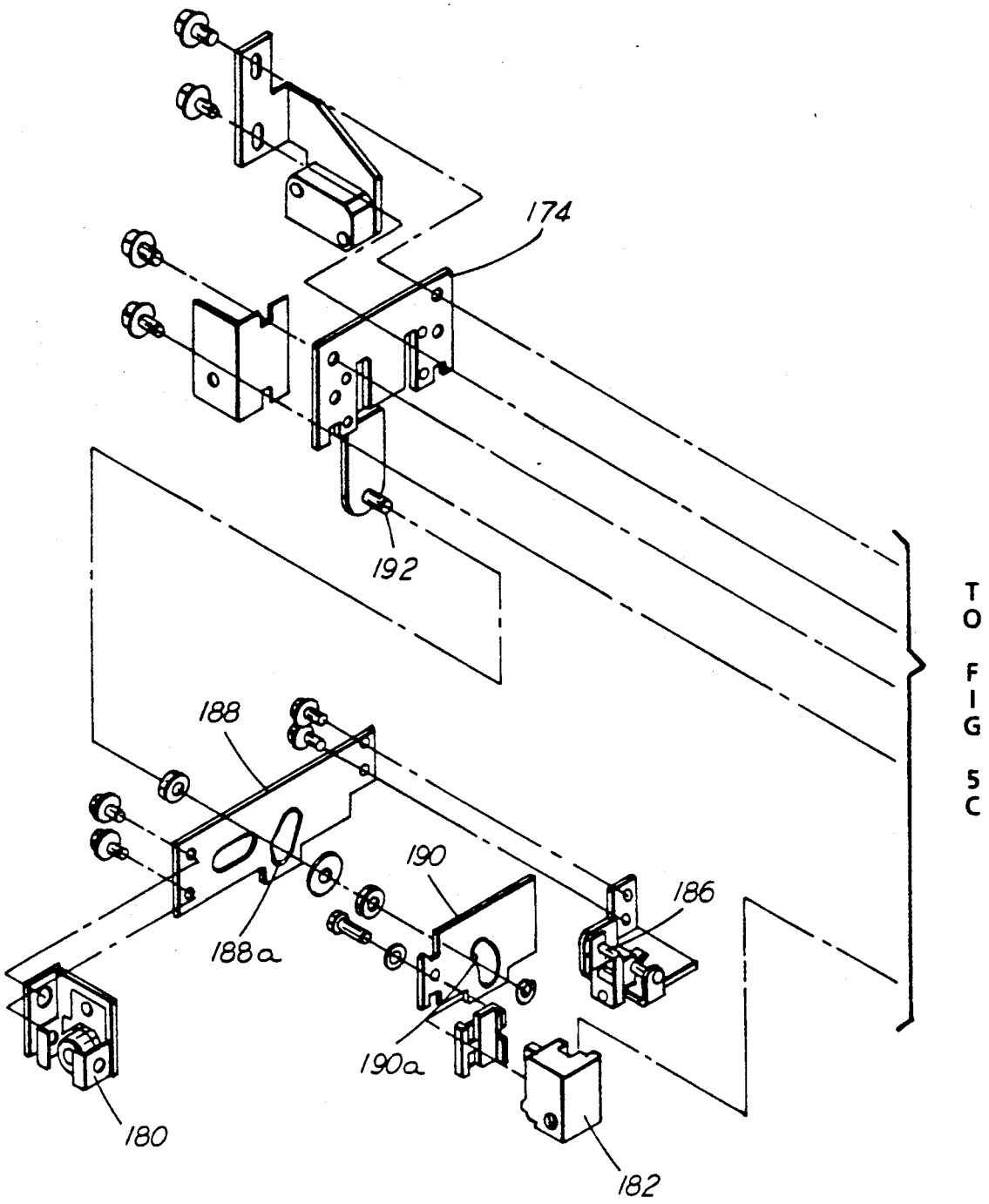
FIG. 5A is one of the FIG. 5 drawings showing a portion of the exploded, perspective view of the stapler head of the FIG. 4 sheet stapling apparatus.
Figure 5B:
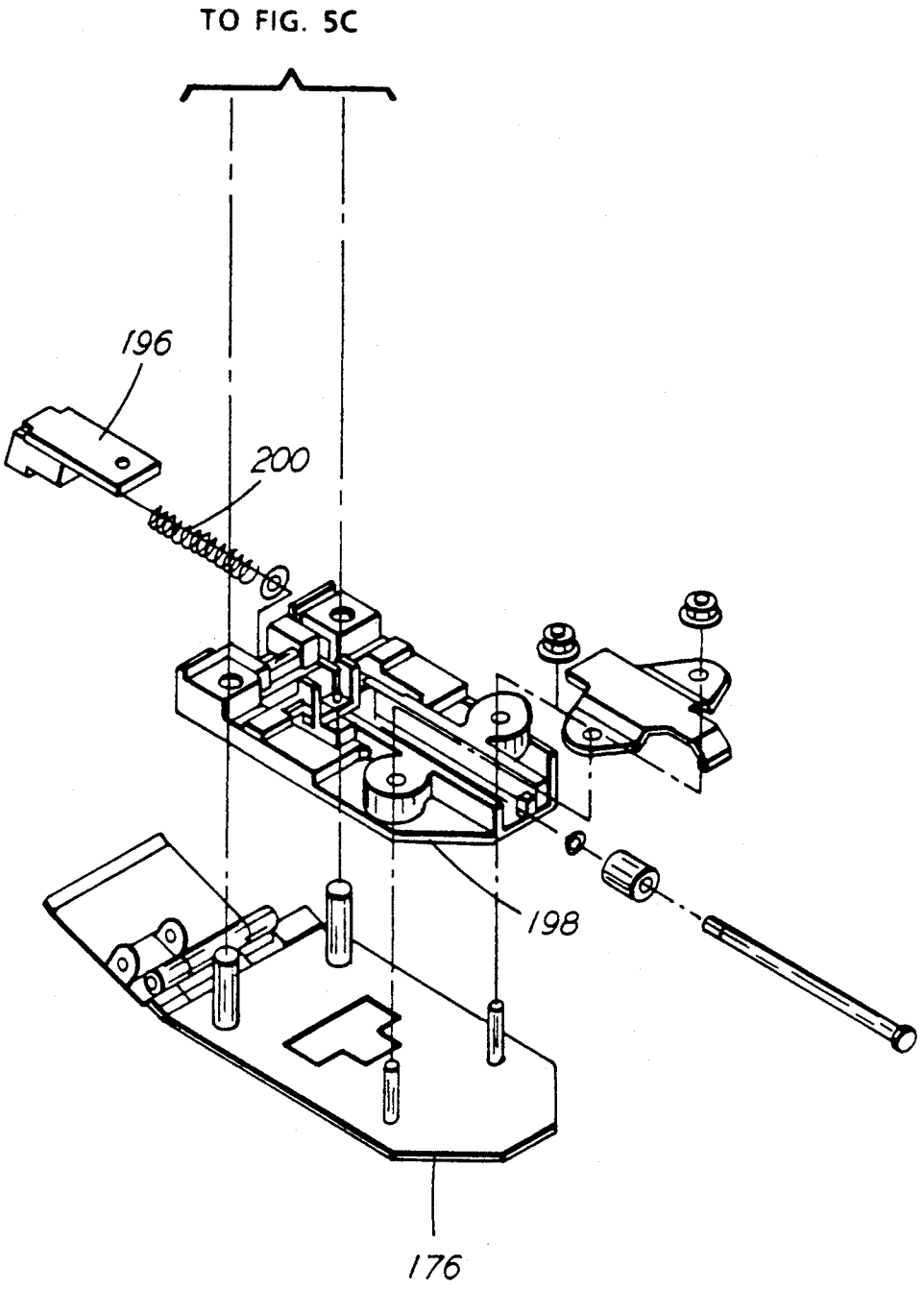
FIG. 5B is one of the FIG. 5 drawings showing a portion of the exploded, perspective view of the stapler head of the FIG. 4 sheet stapling apparatus.
Figure 5C:
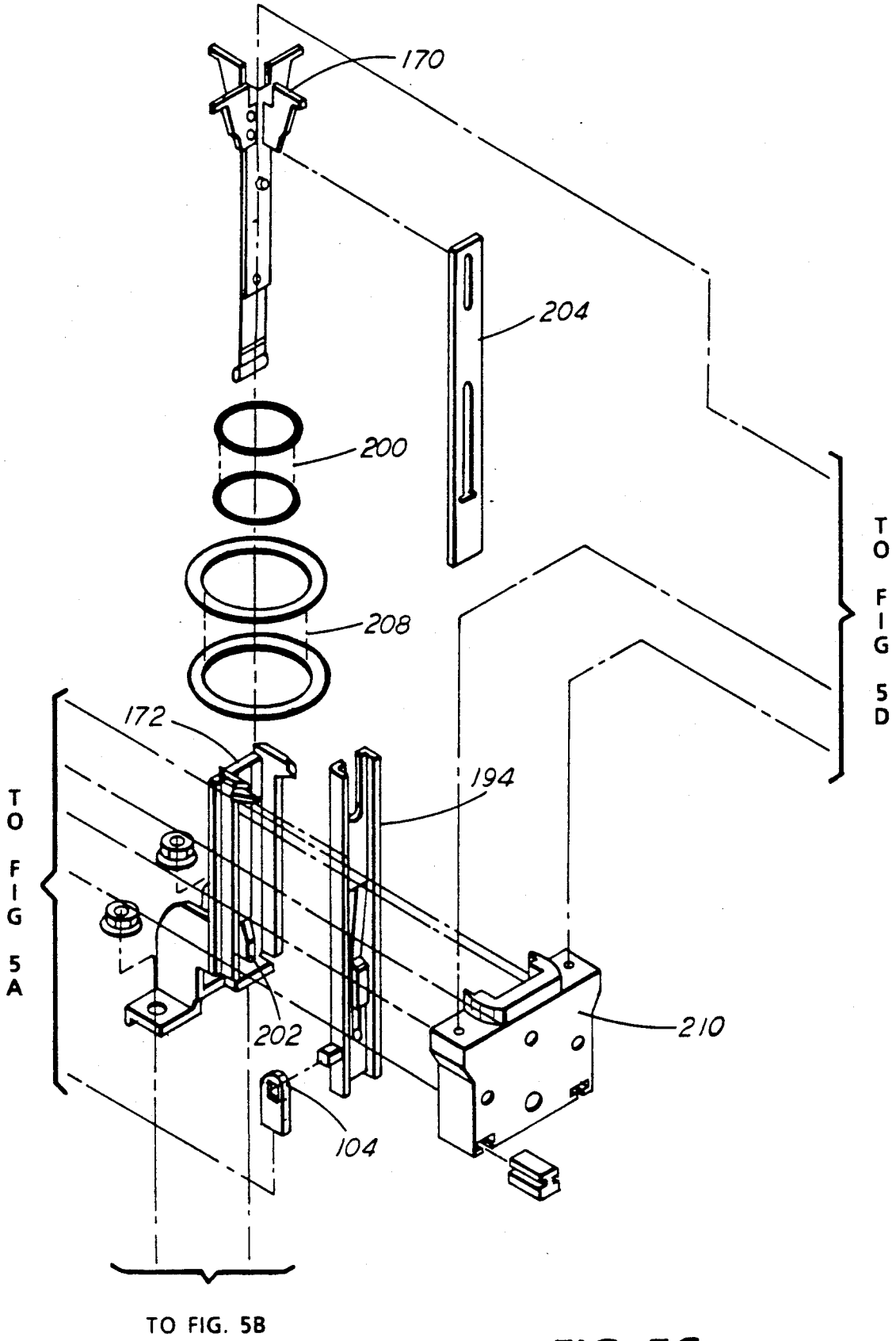
FIG. 5C is one of the FIG. 5 drawings showing a portion of the exploded, perspective view of the stapler head of the FIG. 4 sheet stapling apparatus.
Figure 5D:
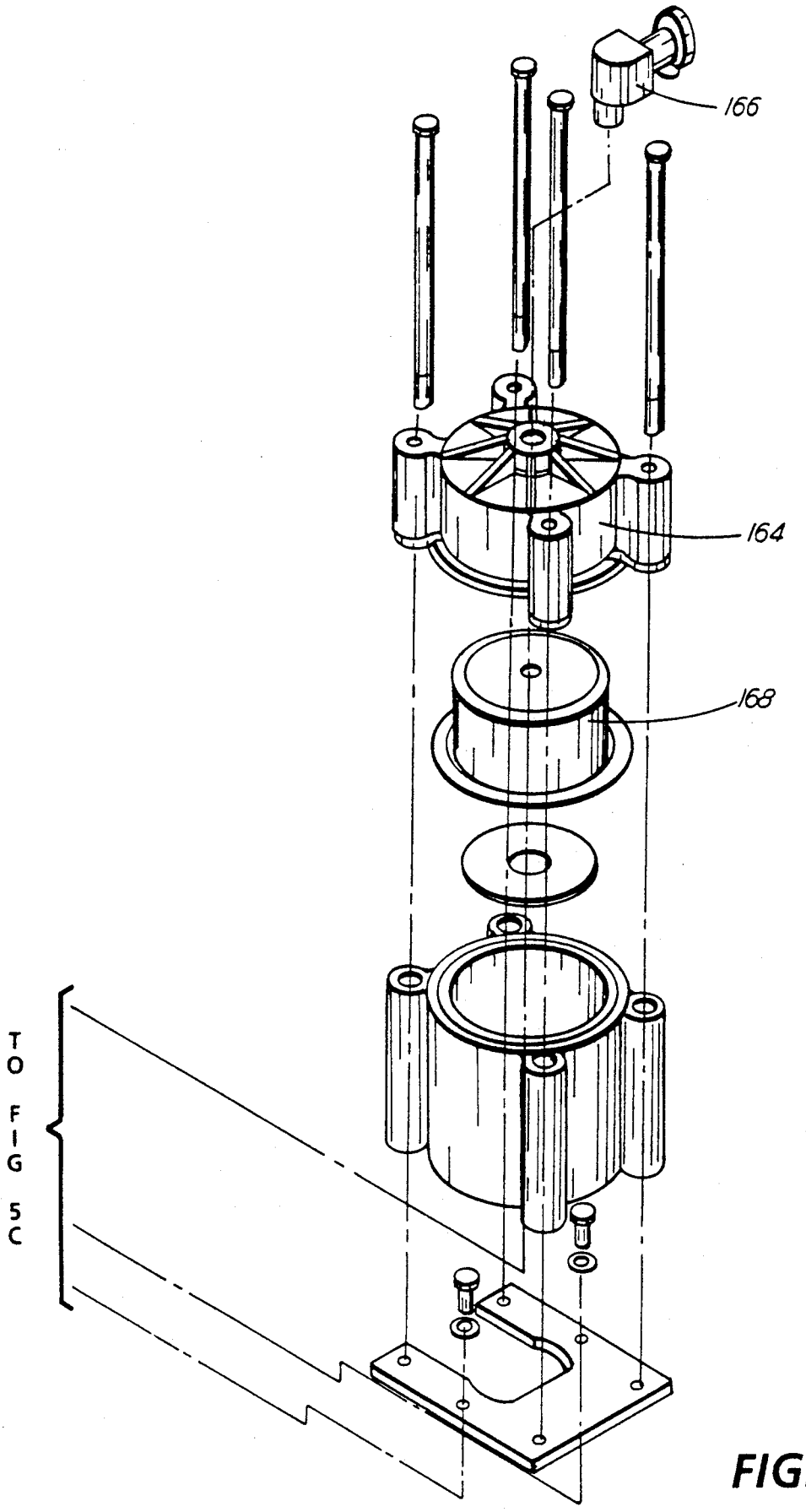
FIG. 5D is one of the FIG. 5 drawings showing a portion of the exploded, perspective view of the stapler head of the FIG. 4 sheet stapling apparatus.

Referring now to FIG. 4, there is shown an exploded, perspective view of stapler 138. Only stapler 138 will be described in detail inasmuch as stapler 140 is substantially identical thereto. Stapler 138 includes a stapler head, indicated generally by reference numeral 154, and a clincher, indicated generally by reference numeral 156. Stapler head 154 and clincher 156 are mounted on frame 158. Bracket 160 is mounted on the opposed surface of frame 158 and arranged to fasten clincher 156 to frame 158. Frame 158 is mounted on carriage 162. Carriage 162 is coupled to the belt and pulley system driven by motor 142 (FIG. 3) so as to be positioned relative to the set of copy sheets for stapling the set in the desired manner. The detailed structure of stapler head 154 will be described hereinafter with reference to FIGS. 5, and 5A through 5D, inclusive.

Turning now to FIGS. 5, and 5A through 5D, inclusive, initially, a continuous wire is fed into stapler head 154. The wire passes through tube coupler 180 through block 182 beneath cutter 184 across the staple forming and driving area and into engagement with actuator 186. Actuator 186 includes a lever arm which is pivoted by the end of the wire to actuate a switch that de-energizes wire feed motor 146 (FIG. 3). In this way, the length of wire between tube coupler 180 and actuator 186 is of a fixed length. However, the length of wire between cutter 184 and actuator 186 is of a variable length. This maximum length of wire held between cutter 184 and actuator 186 corresponds to the longest wire required for the thickest set of copy sheets being stapled. For example, the maximum length of wire is about 32 millimeters long from the cutting face of cutter 184 to actuator 186. This is the required length of wire necessary to staple 65 sheets of 20 pound weight paper. Stapler head 154 has an air cylinder 164 which receives compressed air, at about 35 pounds per square inch, from compressor 136 (FIG. 3) through intake fitting 166. The compressed air received in air cylinder 164 compresses bellows 168. As bellows 168 compresses, piston 170 moves downwardly to move clamping bar 172 in a downward direction with respect to face plate 174. Face plate 174 is mounted fixedly on housing 210 which, in turn, is mounted fixedly on frame 158 (FIG. 4). Clamping bar 172 has clamping base 176 mounted on one end thereof. Piston 170 moves downwardly to press clamping base 176 against the set of copy sheets. During this clamping operation, the angled slots 188*a* and 190*a* in plates 188 and 190, respectively, follow the stationary pin 192 of face plate 174. This moves plates 188 and 190 in opposite directions. Actuator 186 is mounted on plate 188. Block 182 having cutter 184 mounted slidably therein is mounted on plate 190. As the plates 188 and 190 slide in opposite directions, cutter 184 moves toward actuator 186. This decreases the length of wire between cutter 184 and actuator 186. When plates 188 and 190 stop moving, the length of wire positioned between actuator 186 and cutter 184 is the correct length for the set of sheets being stapled and cutter 184 is at the cutting position. The length of wire is determined by the amount of plate movement, and the amount of plate movement is determined by the plate travel with respect to the stationary pin 192. The travel of plates 188 and 190 is proportional to the thickness of the set of copy sheets. This results in the length of wire between actuator 186 and cutter 184 being proportional to the set of copy sheets being stapled. For example, the thicker the set of copy sheets, the less the plate movement and the longer the wire. Alternatively, the thinner the set of copy sheets, the more the plate movement and the shorter the wire. In this way, the length of the wire varies from 32 millimeters for thick sets of about 7 millimeters to about 24 millimeters for thin, two sheet sets. Piston 170 continues to move downwardly after the set of copy sheets is clamped and the wire length set. Wire cutter 184 is coupled to forming bar 194. Forming bar 194 is mounted slidably in clamping bar 172. Piston 170 drives forming bar 194 downwardly so as to slide wire cutter 184 downwardly to shear the wire. After the wire is cut, the end of forming bar 194 contacts each end of the wire. The center portion of the wire is held in a shallow groove between anvil 196, forming bar 194 and clamping base 176 while forming bar 194 bends the wire ends at right angles around the anvil to form the staple wire legs. Anvil 196 is mounted slidably on plate 198. Spring 200 resiliently presses anvil 196 against stops on plate 200 with one end adjacent one end of forming bar 194 with the wire being supported horizontal face of anvil 196. As forming bar 194 moves downwardly, it bends the wire ends at right angles around the anvil to form the staple wire legs. Piston 170 continues to displace forming bar 170 to provide support walls that enclose the legs of the staple for directional control as the staple is being driven through the set of copy sheets. At the end of the travel of forming bar 194, a cam face, at the tip of forming bar 194, contacts the sloping surface of anvil 196 forcing the horizontal face of the anvil from beneath the crown of the staple. At this point, piston 170 contacts an angled protrusion extending outwardly from clamping bar 172 which forces piston 170 aside and disconnects piston 170 from forming bar 194. Piston 170 now moves driving bar 204 downwardly to contact the crown of the formed staple. As driving bar 204 moves downwardly, the staple moves downwardly and is resiliently supported by the sloping surface of anvil 196. Driving bar 204 forces anvil 196 aside and drives the staple downwardly so that the legs of the staple are driven through the set of copy sheets. After the staple legs have exited from one surface of the set of copy sheets and the crown of the staple is pressed against the other surface of the set of copy sheets, the clincher air valve is opened to supply compressed air to the clincher. The clincher air valve solenoid is energized and the clinchers pivot to bend the staple legs into contact with the surface of the set of copy sheets. Grooves in each clincher face support the legs and guide the legs for a straight clinch and prevent crooked or rolled over staples from forming. The clinchers are reset when the solenoid de-energizes and vents the residual air pressure to the atmosphere. A spring pivots the clinchers to the start position for the next clinching cycle. Stapler head 154 is reset to its starting position when the stapler head air valve is closed by de-energizing the air valve solenoid. The compressed air supply is prevented from entering air cylinder 164 and the residual compressed air in cylinder 164 is vented to the atmosphere. Springs 206 and 208 return the piston, forming bar, driving bar and clamping bar to their start positions in preparation for the next stapling cycle.

In recapitulation, the sheet stapling apparatus of the present invention receives a predetermined length of wire and moves the wire cutter along the received wire to the cutting position as the set clamper clamps the set of copy sheets to one another. The wire cutter then cuts a length of wire that is proportional to the thickness of the set of copy sheets. The wire is then formed into a staple and the staple legs driven through the set of copy sheets. The legs of the staple are clinched to staple the set of copy sheets together.

It is, therefore, evident that there has been provided, in accordance with the present invention, a sheet stapling apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for stapling a set of sheets, including:

means for holding a fixed, predetermined length of wire with the length of the wire being held by said holding means being independent of the thickness of the set of sheets;

a wire cutter;

means for clamping the set of sheets;

means for moving said clamping means into engagement with the set of sheets;

means, responsive to the movement of said clamping means, for positioning said wire cutter along the predetermined length of wire in said holding means to a cutting position, said moving means applying a force on said wire cutter causing said wire cutter to shear the wire at the cutting position;

means for forming the cut piece of wire into a staple; and means for driving the staple through the set of sheets to staple the sheets together.

2. An apparatus according to claim 1, further including means for resiliently supporting the staple.

3. An apparatus according to claim 2, wherein said moving means moves said forming means.

4. An apparatus according to claim 3, wherein said moving means moves said driving means.

5. An apparatus according to claim 4, wherein said forming means and said wire cutter move in unison with one another.

6. An apparatus according to claim 5, further including means for feeding wire to said holding means.

7. An apparatus according to claim 6, wherein said holding means includes switch means, energized by the wire after the predetermined length has been fed into said holding means, for de-energizing said feeding means.

8. An apparatus according to claim 5, wherein said moving means includes:

a piston adapted to move said forming means and said said driving means; and pneumatic means for moving said piston.

9. An apparatus according to claim 8, wherein said moving means includes means for de-coupling said forming means from said piston after said piston has moved a first predetermined distance.

10. An apparatus according to claim 9, wherein said moving means includes means for coupling said driving means to said piston after said piston has moved a second predetermined distance.

11. An apparatus according to claim 10, wherein said clamping means includes:

a frame;

a clamping bar mounted movably on said frame; and a clamping base secured to one end of said clamping bar and defining a surface extending in a direction substantially normal to said clamping bar and arranged to engage the set of sheets, said clamping bar being moved relative to said frame by said piston.

12. An apparatus according to claim 11, wherein said positioning means includes:

at least one plate mounted slidably on said clamping base, said wire cutter being mounted on said plate; and means, mounted on said frame, for sliding said plate in response to said clamping bar moving relative to said frame.

13. An apparatus according to claim 12, wherein said forming means includes a forming bar mounted slidably in said clamping bar, said forming bar having said wire cutter secured thereto to move in unison therewith.

14. An apparatus according to claim 13, wherein said piston includes a piston bar mounted in said forming bar and adapted to drive said forming bar the first predetermined distance wherein said decoupling means disengages said piston bar from said forming bar and said piston bar slides relative to said forming bar.

15. An apparatus according to claim 14, wherein said driving means includes a driving bar mounted slidably in said forming bar and having one end engaging the staple, said piston bar being adapted to engage said driving bar after said piston has moved the second predetermined distance to move said driving bar to drive the staple through the set of sheets.

16. An apparatus according to claim 15, further including means for clinching the staple after said driving bar has driven the staple through the set of sheets.

17. An electrophotographic printing machine of the type in which successive copy sheets having indicia recorded thereon are compiled into sets and the sheets of each set are stapled together, wherein the improved stapling apparatus includes means for holding a fixed, predetermined length of wire with the length of the wire being held by said holding means being independent of the thickness of the set of sheets;

a wire cutter;

means for clamping the set of sheets;

means for moving said clamping means into engagement with the set of sheets;

means, responsive to the movement of said clamping means, for positioning said wire cutter along the predetermined length of wire in said holding means to a cutting position, said moving means applying a force on said wire cutter causing said wire cutter to shear the wire at the cutting position;

means for forming the cut piece of wire into a staple; and means for driving the staple through the set of sheets to staple the sheets together.

18. A printing machine according to claim 17, further including means for resiliently supporting the staple.

19. A printing machine according to claim 18, wherein said moving means moves said forming means.

20. A printing machine according to claim 19, wherein said moving means moves said driving means.

21. A printing machine according to claim 20, wherein said forming means and said wire cutter move in unison with one another.

22. A printing machine according to claim 21, further including means for feeding wire to said holding means.

23. A printing machine according to claim 22, wherein said holding means includes switch means, energized by the wire after the predetermined length has been fed into said holding means, for de-energizing said feeding means.

24. A printing machine according to claim 20, wherein said moving means includes:

a piston adapted to move said forming means and said driving means; and pneumatic means for moving said piston.

25. A printing machine according to claim 24, wherein said moving means includes means for de-coupling said forming means from said piston after said piston has moved a first predetermined distance.

26. A printing machine according to claim 25, wherein said moving means includes means for coupling said driving means to said piston after said piston has moved a second predetermined distance.

27. A printing machine according to claim 26, wherein said clamping means includes:

a frame;

a clamping bar mounted movably on said frame; and a clamping base secured to one end of said clamping bar and defining a surface extending in a direction substantially normal to said clamping bar and arranged to engage the set of sheets said clamping bar being moved relative to said frame by said piston.

28. A printing machine according to claim 27, wherein said positioning means includes:

a plate mounted slidably on said clamping base, said wire cutter being mounted on said plate; and means, mounted on said frame, for sliding said plate in response to said clamping bar moving relative to said frame.

29. A printing machine according to claim 28, wherein said forming means includes a forming bar mounted slidably in said clamping bar, said forming bar having said wire cutter secured thereto to move in unison therewith.

30. A printing machine according to claim 29, wherein said piston includes a piston bar mounted in said forming bar and adapted to drive said forming bar the first predetermined distance wherein said decoupling means disengages said piston bar from said forming bar and said piston bar slides relative to said forming bar.

31. A printing machine according to claim 30, wherein said driving means includes a driving bar mounted slidably in said forming bar and having one end engaging the staple, said piston bar being adapted to engage said driving bar after said piston has moved the second predetermined distance to move said driving bar to drive the staple through the set of sheets.

32. A printing machine according to claim 30, further including means for clinching the staple after said driving bar has driven the staple through the set of sheets.

* * * * *